US011588217B2

(12) United States Patent
Matsumoto et al.

(10) Patent No.: US 11,588,217 B2
(45) Date of Patent: Feb. 21, 2023

(54) HIGH-FREQUENCY MODULE

(71) Applicant: Murata Manufacturing Co., Ltd., Kyoto (JP)

(72) Inventors: Shou Matsumoto, Kyoto (JP); Isao Takenaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 454 days.

(21) Appl. No.: 16/817,150

(22) Filed: Mar. 12, 2020

(65) Prior Publication Data

US 2020/0212529 A1 Jul. 2, 2020

Related U.S. Application Data

(63) Continuation of application No. PCT/JP2018/033141, filed on Sep. 7, 2018.

(30) Foreign Application Priority Data

Sep. 13, 2017 (JP) ..... JP2017-175729

(51) Int. Cl.
*H01P 5/18* (2006.01)
*H01P 1/15* (2006.01)

(52) U.S. Cl.
CPC ..... *H01P 1/15* (2013.01); *H01P 5/18* (2013.01); *H01P 5/184* (2013.01)

(58) Field of Classification Search
CPC .. H01P 5/18; H01P 5/184; H01P 5/187; H01P 5/185; H01P 5/12; H01P 1/15
See application file for complete search history.

(56) References Cited

U.S. PATENT DOCUMENTS

| | | | |
|---|---|---|---|
| 2012/0161897 | A1 | 6/2012 | Tamaru et al. |
| 2015/0236666 | A1 | 8/2015 | Ootsuka et al. |
| 2016/0268994 | A1 | 9/2016 | Granger-Jones et al. |
| 2017/0310355 | A1 | 10/2017 | Hayakawa |

FOREIGN PATENT DOCUMENTS

| | | | |
|---|---|---|---|
| JP | 2015-154373 | A | 8/2015 |
| JP | 2017-038115 | A | 2/2017 |
| WO | 2011-074370 | A1 | 6/2011 |
| WO | 2016-121455 | A1 | 8/2016 |

OTHER PUBLICATIONS

International Search Report for International Application No. PCT/JP2018/033141 dated Nov. 13, 2018.
Written Opinion for International Application No. PCT/JP2018/033141 dated Nov. 13, 2018.

*Primary Examiner* — Stephen E. Jones
(74) *Attorney, Agent, or Firm* — Pearne & Gordon LLP

(57) ABSTRACT

Isolation characteristics of a directional coupler are improved. A high-frequency module (1) includes a substrate (2) and a directional coupler (5) provided on the substrate (2). The directional coupler (5) includes a main line (51), a sub line (52), and an impedance adjustment portion (7). The sub line (52) is electromagnetically coupled to the main line (51). The impedance adjustment portion (7) is provided in the sub line (52), and adjusts impedance of the directional coupler (5). The impedance adjustment portion (7) is electrically connected to an inductor of the substrate (2).

20 Claims, 2 Drawing Sheets

HIGH-FREQUENCY MODULE

This is a continuation of International Application No. PCT/JP2018/033141 filed on Sep. 7, 2018 which claims priority from Japanese Patent Application No. 2017-175729 filed on Sep. 13, 2017. The contents of these applications are incorporated herein by reference in their entireties.

BACKGROUND OF THE DISCLOSURE

Field of the Disclosure

The present disclosure relates to a high-frequency module including a directional coupler provided on a substrate.

Description of the Related Art

Various high-frequency modules having directional couplers provided in or on a substrate have been developed (see, for example, Patent Document 1).

A directional coupler described in Patent Document 1 is used to detect a signal level of a high-frequency signal transmitted or received by an antenna. The directional coupler described in Patent Document 1 includes a matching unit having two inductors for adjusting impedance. One of the two inductors is configured by only an inductor configuration layer, and the other is configured by a plurality of through-holes.

Patent Document 1: Japanese Unexamined Patent Application Publication No. 2017-38115.

BRIEF SUMMARY OF THE DISCLOSURE

In recent years, there has been a demand for miniaturization in a high-frequency module including a directional coupler. That is, in the high-frequency module, for example, it is required to arrange a directional coupler and other circuit elements (for example, an antenna switch) in close to each other, to integrate the directional coupler and the other circuit elements into one chip, and so on.

However, in the existing high-frequency module, in a case where the directional coupler and the other circuit elements are arranged close to each other or the directional coupler and the other circuit elements are integrated into one chip, the isolation characteristics of the directional coupler are not good only with an inductor in the directional coupler.

Although it is conceivable to further provide an adjustment element (for example, an inductor) in the directional coupler for adjusting the impedance of the directional coupler, when the adjustment element is provided in the directional coupler, the directional coupler is increased in size.

As described above, the existing high-frequency module has a problem that it is difficult to obtain good isolation characteristics of the directional coupler while being small in size.

The present disclosure has been made in view of the above problem, and an object of the present disclosure is to provide a high-frequency module capable of improving the isolation characteristics of a directional coupler.

A high-frequency module according to an aspect of the present disclosure includes a substrate and a directional coupler. The directional coupler is provided on the substrate. The directional coupler includes a first input/output port, a second input/output port, a main line, a sub line, and an impedance adjustment portion. The main line connects the first input/output port and the second input/output port. The sub line is electromagnetically coupled to the main line. The impedance adjustment portion is provided in the sub line. The impedance adjustment portion adjusts impedance of the directional coupler. The substrate includes an inductor. The impedance adjustment portion is electrically connected to the inductor of the substrate.

According to the high-frequency module in the above aspect of the present disclosure, it is possible to improve the isolation characteristics of the directional coupler.

DETAILED DESCRIPTION OF THE DISCLOSURE (Embodiment)

Hereinafter, a high-frequency module according to an embodiment will be described with reference to the drawings.

Figure 1:
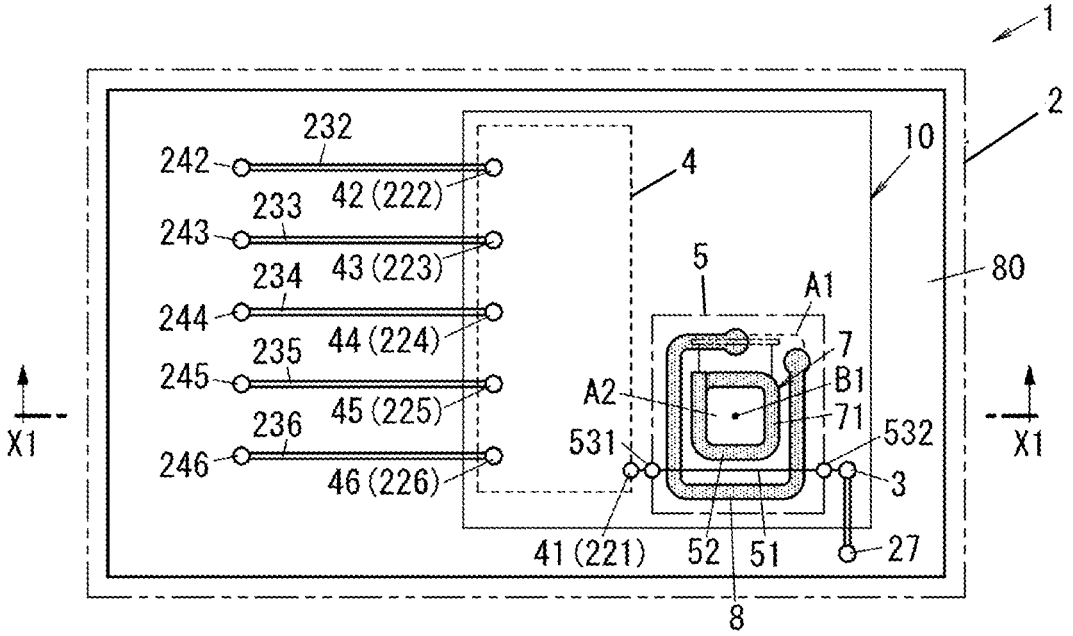
FIG. 1 is a layout diagram of a high-frequency module according to an embodiment of the present disclosure.
Figure 2:
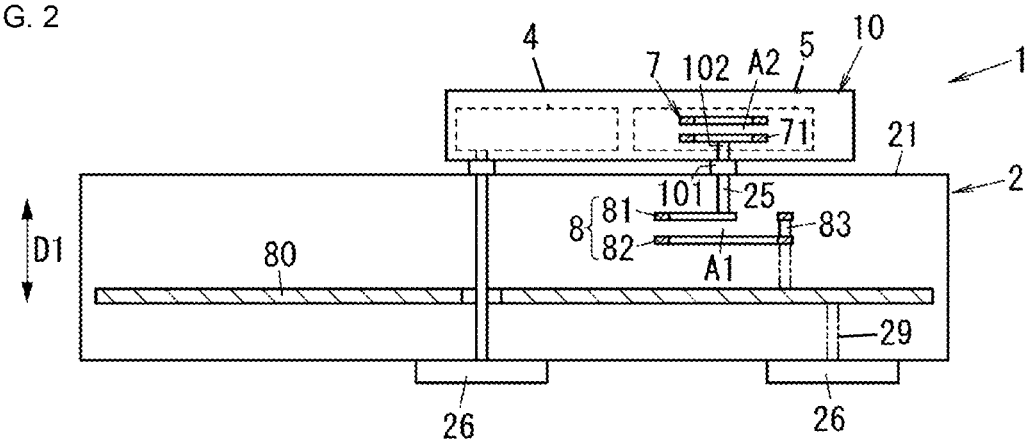
FIG. 2 is a cross-sectional view of the high-frequency module.

FIG. 1 and FIG. 2, which are described in the following embodiment and the like, are schematic diagrams, and each ratio of the size and thickness of each constituent element in the drawings does not necessarily reflect an actual dimension ratio. FIG. 2 is a cross-sectional view taken along the line X1-X1 in FIG. 1.

(1) Overall Configuration of High-Frequency Module

Figure 3:
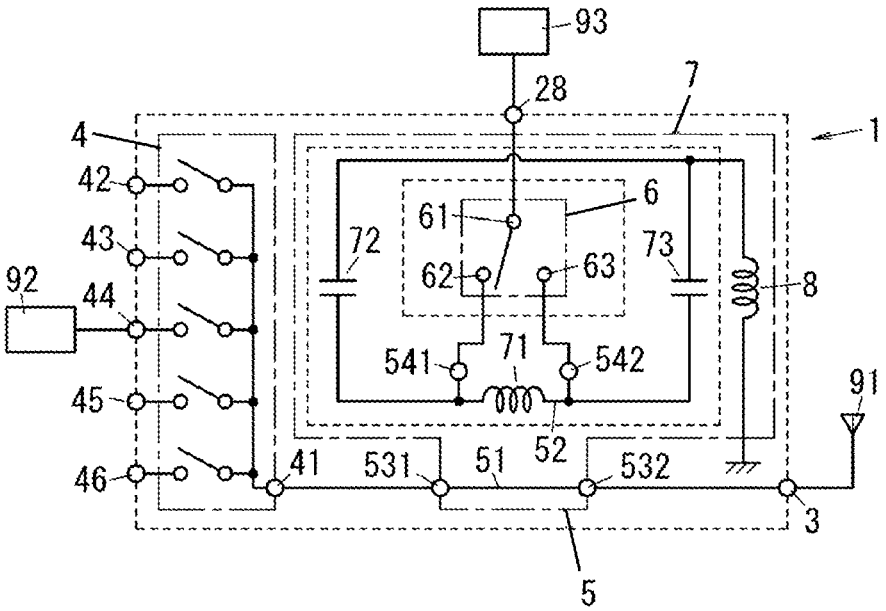
FIG. 3 is a circuit diagram of the high-frequency module.

As illustrated in FIG. 1, a high-frequency module 1 according to the present embodiment includes a substrate 2, a chip type element 10, and a ground conductor 80. As illustrated in FIG. 3, for example, an antenna 91, a communication circuit 92, and a detection circuit 93 are connected to the high-frequency module 1.

The high-frequency module 1 according to the present embodiment is used, for example, as a high-frequency module connected to the antenna 91 for transmitting or receiving a high-frequency signal, in a communication device such as a mobile phone.

In the high-frequency module 1 as described above, as illustrated in FIG. 2, a second inductor 8 is provided inside the substrate 2. One end of the second inductor 8 is electrically connected to an impedance adjustment portion 7 of a directional coupler 5. Another end of the second inductor 8 is connected to an external connection electrode 26 of a reference potential (ground potential). Further, as illustrated in FIG. 1, in a plan view from a thickness direction D1 of the substrate 2, a winding axis B1 of a first inductor 71 of the impedance adjustment portion 7 is located within a formation region A1 of the second inductor 8 in the substrate 2. In other words, at least a part of the formation region A2 of the first inductor 71 of the impedance adjustment portion 7 overlaps with the formation region A1 of the second inductor 8 of the substrate 2.

(2) Each Constituent Element of High-Frequency Module

Next, each constituent element of the high-frequency module 1 according to the present embodiment will be described.

(2.1) Substrate

As illustrated in FIG. 2, the substrate 2 is a substrate on which the chip type element 10 is mounted. Although partially omitted from the drawing, the substrate 2 of the present embodiment is a multilayer substrate in which a plurality of layers is laminated. In the present embodiment, each of the plurality of layers forming the substrate 2 is, for example, a dielectric layer. A conductive member is provided in at least a part of each layer. More specifically, each layer is provided with a wiring (not illustrated) patterned on a surface of the dielectric layer as a conductive member, and a via (not illustrated) passing through the dielectric layer.

As illustrated in FIG. 1, a plurality of connection terminals 221 to 226 is provided on a main surface 21 on which the chip type element 10 is mounted, in the substrate 2. The connection terminal 221 is provided at a position corresponding to a common terminal 41 of the antenna switch 4, which will be described later. The plurality of connection terminals 222 to 226 is provided at a position corresponding to selection terminals 42 to 46 of the antenna switch 4. Each of the connection terminals 221 to 226 is a conductive via, for example. The connection terminals 222 to 226 are connected to the connection terminals 242 to 246 through wirings 232 to 236 inside the substrate 2, respectively. Each of the connection terminals 242 to 246 is a conductive via, for example.

Further, separately from the above-described vias, as illustrated in FIG. 2, the substrate 2 has a conductive via 25. The via 25 is formed so as to pass through at least one layer among the plurality of layers forming the substrate 2.

A plurality of (two in an illustrated example) external connection electrodes 26 is provided on the substrate 2. The external connection electrode 26 is an electrode for mounting the high-frequency module 1 on an external substrate (not illustrated). One of the external connection electrodes 26 is connected to a ground potential.

(2.2) Chip Type Element

As illustrated in FIG. 1 to FIG. 3, the chip type element 10 includes an antenna terminal 3, an antenna switch 4, a directional coupler (coupler) 5, and a coupler switch 6. The chip type element 10 is a packaged circuit component having a substantially rectangular parallelepiped shape. In other words, in the chip type element 10, the antenna terminal 3, the antenna switch 4, the directional coupler 5, and the coupler switch 6 are integrated. Additionally, the chip type element 10 is mounted on the main surface 21 of the substrate 2. That is, the chip type element 10 is provided on the substrate 2.

(2.3) Antenna Terminal

The antenna terminal 3 is a terminal to which the antenna 91 is connected. More specifically, the antenna 91 is connected to the antenna terminal 3 via a connection terminal 27 of the substrate 2. Further, the antenna terminal 3 is connected to a second input/output port 532, which will be described later, of the directional coupler 5.

The antenna 91 has a function of radiating a high-frequency signal into the air as an electromagnetic wave, and a function of receiving an electromagnetic wave which propagates in the air.

(2.4) Antenna Switch

As illustrated in FIG. 1 and FIG. 3, the antenna switch 4 includes the common terminal 41 as a common end and the plurality of (five in the illustrated example) selection terminals 42 to 46 serving as a plurality of selection ends. The common terminal 41 is connected to a first input/output port 531, which will be described later, of the directional coupler 5. The selection terminals 42 to 46 are connected to the connection terminals 222 to 226 provided on the substrate 2, respectively. The antenna switch 4 is configured to switch a selection terminal to be connected to the common terminal 41 among the plurality of selection terminals 42 to 46.

The communication circuit 92 (only the communication circuit 92 connected to the selection terminal 44 is illustrated in FIG. 3), for example, is connected to the plurality of selection terminals 42 to 46 via the corresponding connection terminals 242 to 246. The communication circuit 92 is, for example, a transmission wave generator which generates a high-frequency signal for transmission via the antenna 91.

(2.5) Directional Coupler

As illustrated in FIG. 1 to FIG. 3, the directional coupler 5 includes a main line 51, a sub line 52, two input/output ports (first input/output port 531, second input/output port 532), and two coupling ports 541 and 542. In addition, the directional coupler 5 includes the impedance adjustment portion 7 and the second inductor 8.

The main line 51 is provided between the antenna terminal 3 and the antenna switch 4. The sub line 52 is provided in the vicinity of the main line 51, and is electromagnetically coupled to the main line 51.

The first input/output port 531 is connected to the antenna switch 4. The second input/output port 532 is connected to the antenna terminal 3. The coupling port 541 is connected to a selection terminal 62, which will be described later, of the coupler switch 6. The coupling port 542 is connected to a selection terminal 63, which will be described later, of the coupler switch 6.

The directional coupler 5 outputs a part of the high-frequency signal propagating between the first input/output port 531 and the second input/output port 532 to the coupling ports 541 and 542. In the directional coupler 5, a part of the high-frequency signal is outputted to the different coupling port 541 or 542 depending on a propagation direction of the high-frequency signal. A part of the high-frequency signal propagating from the first input/output port 531 to the second input/output port 532 is outputted to the coupling port 541. On the other hand, a part of the high-frequency signal propagating from the second input/output port 532 to the first input/output port 531 is outputted to the coupling port 542.

(2.5.1) Impedance Adjustment Portion

The impedance adjustment portion 7 is configured to adjust impedance of the directional coupler 5. However, since the impedance adjustment portion 7 cannot obtain sufficient inductance to improve the isolation characteristics of the directional coupler 5, the impedance of the directional coupler 5 is adjusted by also using the second inductor 8 (the inductor of the substrate 2) described later.

The impedance adjustment portion 7 includes the first inductor 71 and a plurality of capacitors 72 and 73 (two in the illustrated example). The impedance adjustment portion 7 is provided in the sub line 52.

The first inductor 71 is provided in the sub line 52. More specifically, the first inductor 71 is provided between the coupling port 541 and the coupling port 542.

The plurality of capacitors 72 and 73 is electrically connected to the first inductor 71 and the second inductor 8. The plurality of capacitors 72 and 73 is connected in parallel between the first inductor 71 and the second inductor 8.

The impedance adjustment portion 7 is electrically connected to the ground conductor 80 via the second inductor 8.

(2.5.2) Second Inductor

As illustrated in FIG. 2, the second inductor 8 includes a plurality of (two in the illustrated example) conductor layers 81 and 82 and a via 83, and is provided in the substrate 2. The second inductor 8 has a two-layered structure including conductor layers 81 and 82.

The second inductor 8 is provided inside the substrate 2 which is a multilayer substrate. More specifically, the second inductor 8 is provided between the main surface 21 on which the chip type element 10 including the directional coupler 5 is provided and the ground conductor 80, inside the substrate 2.

The second inductor 8 is electrically connected to the impedance adjustment portion 7 through the via 25. More specifically, the second inductor 8 is electrically connected to the capacitors 72 and 73 through the via 25, a bump 101, and a connection terminal 102.

The second inductor 8 has a looped shape in the plan view from the thickness direction D1 of the substrate 2. More specifically, the second inductor 8 has a quadrangular looped shape in the plan view from the thickness direction D1 of the substrate 2.

The plurality of conductor layers 81 and 82 is a pattern electrode provided on a surface of each of the layers inside the substrate 2. The conductor layers 81 and 82 are wound around a winding axis of the second inductor 8. In the present embodiment, the winding axis of the second inductor 8 coincides with the winding axis B1 of the first inductor 71 in the plan view from the thickness direction D1 of the substrate 2.

The via 83 is provided so as to pass through a layer located between the conductor layer 81 and the conductor layer 82 among the plurality of layers of the substrate 2, and electrically connects the conductor layer 81 and the conductor layer 82. That is, the plurality of conductor layers 81 and 82 is electrically connected to each other.

(2.6) Ground Conductor

The ground conductor 80 is provided in the substrate 2. More specifically, the ground conductor 80 is provided inside the substrate 2 which is the multilayer substrate. In other words, the ground conductor 80 is provided on any one of the plurality of layers of the substrate 2. The second inductor 8 is electrically connected to the ground conductor 80.

As described above, the impedance adjustment portion 7 is electrically connected to the ground conductor 80 via the second inductor 8.

The ground conductor 80 is electrically connected to the external connection electrode 26 which is the ground potential through a via 29. The ground conductor 80 is connected to the ground potential via the external connection electrode 26 in the usage state.

(2.7) Arrangement Relation Between First Inductor and Second Inductor

As illustrated in FIG. 1, in the plan view from the thickness direction D1 of the substrate 2, the winding axis B1 of the first inductor 71 is located within the formation region A1 of the second inductor 8 in the substrate 2. In other words, in the plan view from the thickness direction D1 of the substrate 2, at least a part of the formation region A2 of the first inductor 71 of the impedance adjustment portion 7 overlaps with the formation region A1 of the second inductor 8 of the substrate 2. In the present embodiment, at least a part of the first inductor 71 is located within the formation region A1 in the plan view from the thickness direction D1 of the substrate 2. More specifically, in the plan view from the thickness direction D1 of the substrate 2, the whole first inductor 71 is located within the formation region A1. That is, in the plan view from the thickness direction D1 of the substrate 2, the entire formation region A2 of the first inductor 71 overlaps with the formation region A1.

Here, the formation region A1 is a region surrounded by an outermost peripheral portion of the looped shape second inductor 8 of the substrate 2 in the plan view from the thickness direction D1 in the substrate 2. That is, in the substrate 2, the formation region A1 includes a region in which the second inductor 8 is provided and a region located on an inner peripheral side of the second inductor 8 (an opening region of the second inductor 8, that is, a coil opening surrounded by a conductor of the second inductor 8).

Similarly, the formation region A2 is a region surrounded by the outermost peripheral portion of the looped shape first inductor 71 in the plan view from the thickness direction D1 of the substrate 2. That is, the formation region A2 includes a region in which the first inductor 71 is provided and a region located on an inner peripheral side of the first inductor 71 (an opening region of the first inductor 71, that is, a coil opening surrounded by a conductor of the first inductor 71).

(2.8) Coupler Switch

As illustrated in FIG. 3, the coupler switch 6 includes a common terminal 61 serving as a common end and a plurality of (two in the illustrated example) selection terminals 62 and 63 serving as a plurality of selection ends. The selection terminal 62 is connected to the coupling port 541 of the directional coupler 5, and the selection terminal 63 is connected to the coupling port 542 of the directional coupler 5.

The coupler switch 6 is a switch circuit for selectively connecting the common terminal 61 and one selection terminal of the selection terminals 62 and 63. The coupler switch 6 is a switch circuit formed by a transistor such as a field-effect transistor (FET), and connects the selected selection terminal (63) and the common terminal 61 based on a signal for driving the coupler switch 6.

The detection circuit 93 is connected to the common terminal 61 of the coupler switch 6 via a connection terminal 28, and detects a high-frequency signal outputted from the common terminal 61.

(3) Effects

In the high-frequency module 1 according to the present embodiment described above, the impedance adjustment portion 7 for adjusting the impedance of the directional coupler 5 is electrically connected to the second inductor 8 of the substrate 2. Thus, an inductance component necessary for adjusting the impedance of the directional coupler 5 can be added, so that the directional coupler 5 can be improved in the isolation characteristics as compared with a case where the impedance of a directional coupler is adjusted by using only an inductor in the directional coupler.

In the high-frequency module 1 according to the present embodiment, in the plan view from the thickness direction D1 of the substrate 2, at least a part of the formation region A2 of the first inductor 71 of the impedance adjustment portion 7 overlaps with the formation region A1 of the second inductor 8 of the substrate 2. In other words, in the plan view from the thickness direction D1 of the substrate 2, the winding axis B1 of the first inductor 71 is located within the formation region A1 of the second inductor 8. Thus, the first inductor 71 of the impedance adjustment portion 7 and the second inductor 8 of the substrate 2 can be electrically coupled to each other. As a result, the mutual inductance between the first inductor 71 and the second inductor 8 can be increased, so that the isolation characteristics of the directional coupler 5 can be further improved.

In the high-frequency module 1 according to the present embodiment, the second inductor 8 is electrically connected to the impedance adjustment portion 7 through the via 25. As a result, compared with a case where the second inductor is electrically connected to the impedance adjustment portion by the wiring on a plane orthogonal to the thickness direction of the substrate, it is possible to reduce the size of the high-frequency module 1.

In the high-frequency module 1 according to the present embodiment, the directional coupler 5 is electrically connected between the antenna switch 4 and the antenna terminal 3. Thus, for example, when a plurality of communication circuits 92 having arbitrary communication bands is respectively connected to the plurality of selection terminals 42 to 46 of the antenna switch 4 in a one-to-one manner, efficiency can be improved as a high-frequency module to communicate using a plurality of communication bands.

In the high-frequency module 1 according to the present embodiment, the antenna switch 4 and the directional coupler 5 are integrated. As a result, compared to a case where an antenna switch and a directional coupler are separately provided, the size of the high-frequency module 1 can be reduced.

In the high-frequency module 1 according to the present embodiment, the second inductor 8 includes the plurality of conductor layers 81 and 82. Thus, the second inductor 8 can be easily formed inside the substrate 2.

In the high-frequency module 1 according to the present embodiment, the second inductor 8 and the ground conductor 80 are provided inside the substrate 2. Thus, it is possible to further reduce the size of the high-frequency module 1.

In the high-frequency module 1 according to the present embodiment, the whole first inductor 71 is located within the formation region A1 of the second inductor 8 in the plan view from the thickness direction D1 of the substrate 2. Thus, the mutual inductance between the first inductor 71 and the second inductor 8 can be further increased.

(4) Modification Example

Note that in the high-frequency module 1 according to the present embodiment, the whole first inductor 71 is located within the formation region A1 of the second inductor 8 in the plan view from the thickness direction D1 of the substrate 2. However, as the high-frequency module 1 according to a modification example of the present embodiment, only a part of the first inductor 71 may be located within the formation region A1 of the second inductor 8. In short, in the plan view from the thickness direction D1 of the substrate 2, at least a part of the first inductor 71 may be located within the formation region A1.

As with the high-frequency module 1 according to the present embodiment, also in the high-frequency module 1 according to the modification example, the mutual inductance between the first inductor 71 and the second inductor 8 can be increased similarly to the high-frequency module 1 according to the present embodiment.

The second inductor 8 is not limited to have a quadrangular looped shape in the plan view from the thickness direction D1 of the substrate 2, and may have a looped shape other than the quadrangular looped shape such as a circular looped shape. In short, the second inductor 8 may have at least a looped shape in the plan view from the thickness direction D1 of the substrate 2. For example, the second inductor 8 may have a spiral shape (votex shape). Here, the spiral second inductor may be a two-dimensional inductor wound in a spiral shape a plurality of times around a winding axis on one plane, or may be a three-dimensional inductor wound in a spiral shape a plurality of times around the winding axis along the winding axis.

The second inductor 8 is not limited to a two-layered structure, and may have a one-layer structure, or may have a structure having three or more layers.

The winding axis of the second inductor 8 is not limited to coinciding with the winding axis B1 of the first inductor 71 in the plan view from the thickness direction D1 of the substrate 2, and may be deviated from the winding axis B1 of the second inductor 71.

The second inductor 8 is not limited to being provided inside the substrate 2, and may be provided on the surface (for example, the main surface 21) of the substrate 2. In short, the second inductor 8 may be provided in or on the substrate 2.

Note that as the high-frequency module 1 according to another modified example of the present embodiment, the substrate 2 is not limited to a multilayer substrate in which a plurality of layers is laminated, and may be a single-layer substrate composed of one layer.

Further, the material for forming the substrate 2 is not particularly limited. In this embodiment, each of the dielectric layers of the substrate 2 is made of ceramic material or the like. Further, the material for forming the connection terminal and the wiring is not also particularly limited. In the present embodiment, for example, a metal or an alloy containing copper as a main component is used.

Although the antenna switch 4 includes the common terminal 41 as a common end, the common end is not limited to a terminal and may be an object other than a terminal such as a part of a wiring. Similarly, although the antenna switch 4 includes the selection terminals 42 to 46 as selection ends, the selection end is not limited to a terminal, and may be an object other than a terminal such as a part of a wiring.

Note that the technique of the present embodiment or the modification example can also be applied to a case where the directional coupler 5 includes a plurality of main lines 51. For example, the arrangement relation in which the winding axis B1 of the first inductor 71 is located within the formation region A1 of the second inductor 8 in the substrate 2 in the plan view from the thickness direction D1 of the substrate 2 can also be applied to a configuration in which the directional coupler 5 includes the plurality of main lines 51. In other words, the relation in which at least a part of the formation region A2 of the first inductor 71 of the impedance adjustment portion 7 overlaps with the formation region A1 of the second inductor 8 can also be applied to a configuration in which the directional coupler 5 includes the plurality of main lines 51.

The embodiment and the modification examples described above are only a part of the various embodiments and modification examples of the present disclosure. In addition, as long as the objects of the present disclosure can be achieved, the embodiment and the modification examples can be changed in various ways according to the design or the like.

(Summary)

It is apparent that the following aspects are disclosed in the embodiment and the like described above.

A high-frequency module (1) according to a first aspect includes a substrate (2) and a directional coupler (5). The directional coupler (5) is provided on the substrate (2). The directional coupler (5) includes a first input/output port (531) and a second input/output port (532), a main line (51), a sub line (52), and an impedance adjustment portion (7). The main line (51) connects the first input/output port (531) and the second input/output port (532). The sub line (52) is electromagnetically coupled to the main line (51). The impedance adjustment portion (7) is provided in the sub line (52). The impedance adjustment portion (7) adjusts impedance of the directional coupler (5). The substrate (2) includes an inductor (second inductor 8). The impedance adjustment portion (7) is electrically connected to the inductor (second inductor 8) of the substrate (2).

In the high-frequency module (1) according to the first aspect, the impedance adjustment portion (7) for adjusting the impedance of the directional coupler (5) is electrically connected to the inductor (second inductor 8) of the substrate (2). Since an inductance component necessary for adjusting the impedance of the directional coupler (5) can be added, the isolation characteristics of the directional coupler (5) can be improved compared to a case where the impedance of the directional coupler is adjusted by using only an inductor in the directional coupler.

In the high-frequency module (1) according to a second aspect, the impedance adjustment portion (7) includes an inductor (first inductor 71) in the first aspect. In a plan view from a thickness direction (D1) of the substrate (2), at least a part of a formation region (A2) of the inductor (first inductor 71) of the impedance adjustment portion (7) overlaps with a formation region (A1) of the inductor (second inductor 8) of the substrate (2).

In the high-frequency module (1) according to the second aspect, in the plan view from the thickness direction (D1) of the substrate (2), at least a part of the formation region (A2) of the inductor (first inductor 71) of the impedance adjustment portion (7) overlaps with the formation region (A1) of the inductor (second inductor 8) of the substrate (2). In other words, in the plan view from the thickness direction (D1) of the substrate (2), the winding axis (B1) of the inductor (first inductor 71) of the impedance adjustment portion (7) is located within the formation region (A1) of the inductor (second inductor 8) of the substrate (2). Thus, the inductor of the impedance adjustment portion 7 and the inductor of the substrate 2 can be electrically coupled to each other. As a result, the mutual inductance between the inductor of the impedance adjustment portion (7) and the inductor of the substrate (2) can be increased, so that the isolation characteristics of the directional coupler (5) can be further improved.

In the high-frequency module (1) according to a third aspect, in the first or second aspect, the impedance adjustment portion (7) is connected to a reference potential via the inductor (the second inductor 8) of the substrate (2).

In the high-frequency module (1) according to a fourth aspect, in any one of the first to third aspects, the substrate (2) has a conductive via (25). The inductor (second inductor 8) of the substrate (2) is electrically connected to the impedance adjustment portion (7) through the via (25).

In the high-frequency module (1) according to the fourth aspect, the inductor (second inductor 8) of the substrate (2) is electrically connected to the impedance adjustment portion (7) through the via (25). As a result, it is possible to reduce the size of the high-frequency module (1), compared with a case where an inductor of a substrate is electrically connected to an impedance adjustment portion by a wiring on a plane orthogonal to a thickness direction of the substrate.

The high-frequency module (1) according to a fifth aspect further includes an antenna terminal (3) and an antenna switch (4) in any one of the first to fourth aspects. An antenna (91) is connected to the antenna terminal (3). The antenna switch (4) has a common terminal (41) and a plurality of selection terminals (42 to 46), and switches a selection terminal connected to the common terminal (41) among the plurality of selection terminals (42 to 46). The directional coupler (5) is arranged between the antenna switch (4) and the antenna terminal (3), and is electrically connected to the antenna switch (4) and the antenna terminal (3).

In the high-frequency module (1) according to the fifth aspect, the directional coupler (5) is electrically connected between the antenna switch (4) and the antenna terminal (3). Thus, for example, in a case where a plurality of communication circuits (92) each having an arbitrary communication band is connected to the plurality of selection terminals (42 to 46) of the antenna switch (4) in a one-to-one manner, it is possible to improve efficiency as a high-frequency module to communicate using a plurality of communication bands.

The high-frequency module (1) according to a sixth aspect further includes the antenna switch (4) in any one of the first to fifth aspects. The antenna switch (4) has the common terminal (41) and the plurality of selection terminals (42 to 46), and switches a selection terminal connected to the common terminal (41) among the plurality of selection terminals (42 to 46). The antenna switch (4) is formed integrally with the directional coupler (5).

In the high-frequency module (1) according to the sixth aspect, the antenna switch (4) and the directional coupler (5) are integrated. As compared with a case where an antenna switch and a directional coupler are provided separately, the size of the high-frequency module (1) can be reduced.

In the high-frequency module (1) according to a seventh aspect, in any one of the first to sixth aspects, the inductor (second inductor 8) of the substrate (2) has a looped shape in the plan view from the thickness direction (D1) of the substrate (2).

In the high-frequency module (1) according to the seventh aspect, the inductor (second inductor 8) of the substrate (2) has a looped shape. Thus, the inductance of the inductor of the substrate (2) and the coupling coefficient between the inductor of the substrate (2) and the inductor (first inductor 71) of the impedance adjustment portion (7) can be increased.

In the high-frequency module (1) according to an eighth aspect, in any one of the first to seventh aspects, the inductor (second inductor 8) of the substrate (2) includes a plurality of conductor layers (81, 82) electrically connected to each other.

In the high-frequency module (1) according to the eighth aspect, the inductor (second inductor 8) of the substrate (2) includes the plurality of conductor layers (81, 82). Thus, the inductor of the substrate (2) can be easily formed inside the substrate (2).

The high-frequency module (9) according to a ninth aspect further includes a ground conductor (80) connected to a reference potential in any one of the first to eighth aspects. The ground conductor (80) is provided in or on the substrate (2), and is electrically connected to the inductor (second inductor 8) of the substrate (2).

In the high-frequency module (1) according to the ninth aspect, the ground conductor (80) is provided in or on the substrate (2). Thus, the degree of freedom in design of the high-frequency module (1) can be increased.

In the high-frequency module (1) according to a tenth aspect, in the ninth aspect, the substrate (2) is a multilayer substrate in which a plurality of layers is laminated. The inductor (second inductor 8) and the ground conductor (80) of the substrate (2) are provided inside the multilayer substrate.

In the high-frequency module (1) according to the tenth aspect, the inductor (second inductor 8) and the ground conductor (80) of the substrate (2) are provided inside the multilayer substrate. Thus, it is possible to further reduce the size of the high-frequency module (1).

In the high-frequency module (1) according to an eleventh aspect, in the tenth aspect, the ground conductor (80) is provided in any one of a plurality of layers of the multilayer substrate. The inductor (second inductor 8) of the substrate (2) is provided between a main surface (21) on which the directional coupler (5) is provided and the ground conductor (80) in the multilayer substrate.

In the high-frequency module (1) according to the eleventh aspect, the inductor (second inductor 8) of the substrate (2) is provided between the main surface (21) of the multilayer substrate and the ground conductor (80). Thus, it is possible to easily adjust both the coupling coefficient between the inductor of the substrate (2) and the inductor (first inductor 71) of the impedance adjustment portion (7), and the inductance of the inductor of the substrate (2).

In the high-frequency module (1) according to a twelfth aspect, in the second aspect, the entire formation region (A2) of the inductor (first inductor 71) of the impedance adjustment portion (7) overlaps with the formation regions (A1) of the inductor (second inductor 8) of the substrate (2) in the plan view from the thickness direction (D1) of the substrate (2).

In the high-frequency module (1) according to the twelfth aspect, the entire formation region (A2) of the inductor (first inductor 71) of the impedance adjustment portion (7) overlaps with the formation region (A1) of the inductor (second inductor 8) of the substrate (2). Thus, the mutual inductance between the inductor of the impedance adjustment portion 7 and the inductor of the substrate (2) can be further increased.

1 HIGH-FREQUENCY MODULE
2 SUBSTRATE
21 MAIN SURFACE
25 VIA
3 ANTENNA TERMINAL
4 ANTENNA SWITCH
41 COMMON TERMINAL
42 to 46 SELECTION TERMINAL
5 DIRECTIONAL COUPLER
51 MAIN LINE
52 SUB LINE
531 FIRST INPUT/OUTPUT PORT
532 SECOND INPUT/OUTPUT PORT
7 IMPEDANCE ADJUSTMENT PORTION
71 FIRST INDUCTOR
8 SECOND INDUCTOR
80 GROUND CONDUCTOR
81 CONDUCTOR LAYER
82 CONDUCTOR LAYER
91 ANTENNA
D1 THICKNESS DIRECTION
A1, A2 FORMATION REGION

The invention claimed is:

1. A high-frequency module comprising:
a first substrate; and
a directional coupler provided on a second substrate mounted on the first substrate,
wherein the directional coupler includes:
a first input/output port and a second input/output port;
a main line connecting the first input/output port and the second input/output port;
a sub line electromagnetically coupled to the main line; and
an impedance adjustment portion provided in the sub line and configured to adjust impedance of the directional coupler, and
wherein
the first substrate includes a first inductor, and
the impedance adjustment portion is electrically connected to the first inductor of the first substrate.

2. The high-frequency module according to claim 1, further comprising:
an antenna terminal to which an antenna is connected; and
an antenna switch having a common terminal and a plurality of selection terminals, and configured to switch a selection terminal connected to the common terminal among the plurality of selection terminals,
wherein the directional coupler is arranged between the antenna switch and the antenna terminal, and is electrically connected to the antenna switch and the antenna terminal.

3. The high-frequency module according to claim 1, further comprising an antenna switch having a common terminal and a plurality of selection terminals, and configured to switch a selection terminal connected to the common terminal among the plurality of selection terminals,
wherein the antenna switch is integrally provided with the directional coupler.

4. The high-frequency module according to claim 1,
wherein the first inductor has a looped shape in a plan view from a thickness direction of the first substrate.

5. The high-frequency module according to claim 1,
wherein the first inductor includes a plurality of conductor layers electrically connected to each other.

6. The high-frequency module according to claim 1,
wherein the first substrate includes a conductive via, and
the first inductor is electrically connected to the impedance adjustment portion through the via.

7. The high-frequency module according to claim 6, further comprising:
an antenna terminal to which an antenna is connected; and
an antenna switch having a common terminal and a plurality of selection terminals, and configured to switch a selection terminal connected to the common terminal among the plurality of selection terminals,
wherein the directional coupler is arranged between the antenna switch and the antenna terminal, and is electrically connected to the antenna switch and the antenna terminal.

8. The high-frequency module according to claim 1 further comprising a ground conductor connected to a reference potential,
wherein the ground conductor is provided in or on the first substrate, and is electrically connected to the first inductor.

9. The high-frequency module according to claim 8,
wherein the first substrate is a multilayer substrate in which a plurality of layers is laminated, and
in the case in which the ground conductor is provided in the first substrate, the first inductor and the ground conductor in the first substrate are provided inside the multilayer substrate.

10. The high-frequency module according to claim 9,
wherein the ground conductor is provided on any one of the plurality of layers inside the multilayer substrate, and
the first inductor is provided in the multilayer substrate between a main surface on which the directional coupler is provided and the ground conductor.

11. The high-frequency module according to claim 1,
wherein the impedance adjustment portion includes a second inductor, and
in a plan view from a thickness direction of the first substrate, at least a part of a formation region of the second inductor overlaps with a formation region of the first inductor.

12. The high-frequency module according to claim 11,
wherein in a plan view from a thickness direction of the first substrate, an entire formation region of the second inductor overlaps with the formation region of the first inductor.

13. The high-frequency module according to claim 11,
wherein the impedance adjustment portion is connected to a reference potential via the first inductor.

14. The high-frequency module according to claim 11, wherein the first substrate includes a conductive via, and the first inductor is electrically connected to the impedance adjustment portion through the via.

15. The high-frequency module according to claim 11, further comprising:

an antenna terminal to which an antenna is connected; and an antenna switch having a common terminal and a plurality of selection terminals, and configured to switch a selection terminal connected to the common terminal among the plurality of selection terminals, wherein the directional coupler is arranged between the antenna switch and the antenna terminal, and is electrically connected to the antenna switch and the antenna terminal.

16. The high-frequency module according to claim 11, further comprising an antenna switch having a common terminal and a plurality of selection terminals, and configured to switch a selection terminal connected to the common terminal among the plurality of selection terminals, wherein the antenna switch is integrally provided with the directional coupler.

17. The high-frequency module according to claim 1, wherein the impedance adjustment portion is connected to a reference potential via the first inductor.

18. The high-frequency module according to claim 17, wherein the first substrate includes a conductive via, and the first inductor is electrically connected to the impedance adjustment portion through the via.

19. The high-frequency module according to claim 17, further comprising:

an antenna terminal to which an antenna is connected; and an antenna switch having a common terminal and a plurality of selection terminals, and configured to switch a selection terminal connected to the common terminal among the plurality of selection terminals, wherein the directional coupler is arranged between the antenna switch and the antenna terminal, and is electrically connected to the antenna switch and the antenna terminal.

20. The high-frequency module according to claim 17, further comprising an antenna switch having a common terminal and a plurality of selection terminals, and configured to switch a selection terminal connected to the common terminal among the plurality of selection terminals, wherein the antenna switch is integrally provided with the directional coupler.

* * * * *